United States Patent [19]

Maruta

[11] Patent Number: 4,811,661

[45] Date of Patent: Mar. 14, 1989

[54] DAMPENING METHOD AND APPARATUS USING AN AIR NOZZLE AND MIST GENERATOR

[76] Inventor: Kazuo Maruta, 346-8, Oaza Takuma, Takuma-cho, Mitoyo-gun, Kagawa, Japan

[21] Appl. No.: 134,789

[22] Filed: Dec. 18, 1987

[30] Foreign Application Priority Data

Dec. 20, 1986 [JP] Japan ..... 61-302840

[51] Int. Cl.[4] ..... B41F 7/30; B41L 25/6

[52] U.S. Cl. ..... 101/147; 101/366; 101/451; 118/63; 239/295

[58] Field of Search ..... 101/148, 147, 366, 451; 239/295, 290, 423; 118/63

[56] References Cited

U.S. PATENT DOCUMENTS 2,622,520 12/1952 Hauser et al. ..... 101/147
2,689,523 9/1954 Koch ..... 101/147
2,753,796 7/1956 Wood et al. ..... 101/147

FOREIGN PATENT DOCUMENTS 2658875 6/1978 Fed. Rep. of Germany ..... 101/147
3108541 11/1982 Fed. Rep. of Germany ..... 101/147
691209 10/1979 U.S.S.R. ..... 239/295

*Primary Examiner*—Clifford D. Crowder
*Attorney, Agent, or Firm*—Michael N. Meller

[57] ABSTRACT

A novel dampening unit for an offset press is proposed, comprising a nozzle (20) with a discharging mouth (21) in the form of a slit directed substantially at a tangent to an outer surface of the plate (6*a*) and extending in the axial direction of the plate cylinder (6), which discharging mouth (21) is disposed near the plate surface. The interior of the nozzle (21) is divided into upper and lower chambers (20*a*, 20*b*) from the innermost area thereof to the discharging mouth (21) by a partition (22) extending in the direction of an air stream over the whole length of the nozzle (20). A device for generating an air stream, such as a fan (23) is disposed within the upper chamber (20*a*) and a device for generating a mist such as an ultrasonic generator (27) is disposed within the lower chamber (20*b*). According to this structure, the mist sucked out from the lower chamber (20*b*) can be stably and effectively held on the plate surface while sandwiched between the plate surface and an air film formed by the air stream ejected from the upper chamber (20*a*).

5 Claims, 3 Drawing Sheets

DAMPENING METHOD AND APPARATUS USING AN AIR NOZZLE AND MIST GENERATOR

BACKGROUND OF THE INVENTION

1. Field of the Invention

The present invention relates to an offset press, more particularly, to a novel method and apparatus for dampening a plate cylinder thereof.

2. Description of the Related Art

In general, in a printing process utilizing an offset press, a water film is formed on part of a plate surface on which there is no image to be printed so that an ink imparted to the plate surface will not stick to the non-image area but will adhere only to an image-carrying area of the plate surface.

The water film must be thin and reproductive, and the film thickness must be varied in accordance with other conditions, such as printing speed, distribution of the image-carrying area and the non-image area, material of the plate, and property of the ink used.

The operation of a dampening unit for the offset press will be described below with reference to FIG. 1, in which part of an offset press provided with the most widely used dampening unit is schematically illustrated.

Water in a pan 1 is lifted by rotation of a water pan roller 2, and adhered to the surface thereof. A water ductor roller 3 is rotatably secured on one end of a lever 3*a* and the other end of the lever 3*a* is pivoted so as to swing between a first position where a surface of the water ductor roller 3 touches that of the water pan roller 2 and a second position where a surface of the water ductor roller 3 touches that of a chrome roller 4. The water ductor roller 3 intermittently transfers the water film formed on the pan roller 2 to the chrome roller 4 by this swing motion. Further, the chrome roller 4 is always in contact with a water form roller 5 disposed above the chrome roller 4, and reciprocates along the length thereof so that the water film carried on the surface of the chrome roller 4 is transferred onto the surface of the water form roller 5 as a uniform film. The water form roller 5 is always in contact with a plate 6*a* carried on the surface of a plate cylinder 6, and thus the water film on the water form roller 5 is transferred to a non-image area of the surface of the plate 6*a*.

Ink is fed from an ink fountain (not shown) to a vibration roller 7 and then to a pair of ink form rollers 8. An ink film formed on the ink form rollers 8 is then transferred to the surface of the plate 6*a* rotating integrally with the plate cylinder 6 while in contact with the surface of the ink form roller 8. During this transfer, the ink selectively adheres to the image carrying area of the plate 6*a* because the oily ink cannot adhere to the rest of the plate surface, i.e., the non-image area, because of the water film carried thereon.

The ink thus selectively adhered to the plate 6*a* is transferred to the surface of a constantly rotating rubber blanket cylinder 9 which is brought into contact with the plate 6*a*, and then is transferred to a paper 11 through a nip gap between the rubber blanket cylinder 9 and an impression cylinder 10 by the rotation of the cylinders 9, 10, and thus, a predetermined print out is obtained.

The conventional offset press provided with the above described dampening unit has the following drawbacks:

First, since the dampening unit uses a plurality of rollers for providing water to the surface of the plate 6*a*, it is very difficult to determine the most preferable conditions for forming a proper water film on the plate 6*a*. Accordingly, frequent trial-and-error operations, with the accompanying waste of time and paper, are necessary before the most favorable stable conditions have been established at the beginning of or a change-over during the printing operation.

Further, since the water form roller 5 is in constant rotation and in contact with the surface of the plate 6*a*, to which a residual ink film is still adhered, this ink film is liable to be transferred to the respective rollers of the dampening unit and thus contaminate the same. Accordingly, these rollers must be removed from the unit and cleaned when the color of the ink is to be changed. In addition, as the thickness of the ink film on the plate 6*a* becomes thicker, the ink is liable to be forced out of the predetermined image area due to the pressure of the water form roller 5 and so-called "ink threading" generates. This, of course, leads to a lowering of the printing quality.

Alternatives to the above dampening unit have been proposed. One such alternative is a "Dahlgren" type dampening unit. In this unit, a metal roller in stable contact with the surfaces of both the water pan roller 2 and the plate cylinder 6 is provided instead of the water ductor roller 3, and alcohol is added to the water to improve the adhesivity thereof to the roller. Another alternative is the "Beko" type dampening unit, which eliminates the water pan 1 and the water pan roller 2 but is provided with a rotor disc having a water conduit. The water is atomized to form a mist which-is jetted onto the surface of the water form roller 5 and transferred to the plate 6*a* via a series of rollers similar to those of the aforesaid unit. These alternatives are advantageous in that the water feeding rate is easily adjustable in accordance with the variance of the printing speed, even in a high speed operation. However, since in these apparatuses the water form roller is always in contact with the surface of the plate, the previously described drawback caused by the water form roller still remains.

SUMMARY OF THE INVENTION

Thus, a general object of the present invention is to eliminate the above drawbacks in the prior art dampening unit to be assembled with the offset press.

A first object of the present invention is to provide a dampening unit having a simple structure in which a water form roller always in contact with a plate cylinder is omitted, and which minimizes the cost and time required for maintenance and cleaning of the unit.

A second object of the present invention is to provide a method for dampening a plate with lower water consumption and without contamination from the environment.

That is, the first object of the present invention is achieved by a unit to be assembled with an offset press for dampening a plate carried by a plate cylinder, comprising a nozzle with a discharging mouth in the form of a slit directed substantially at a tangent to an outer surface of the plate and extending in the axial direction of the plate cylinder, the discharging mouth being disposed in the vicinity of the surface of the plate, and the interior of the nozzle being divided into upper and lower chambers from the innermost area thereof to the discharging mouth by a partition extending in the direction of an air stream over the whole length of the nozzle; means for generating an air stream through the upper chamber disposed within the upper chamber; and means for generating a mist disposed within the lower chamber.

Preferably, the means for generating an air stream is a fan, a blower or a jet connected to a pressurized air source.

Advantageously, the means for generating a water mist comprises a water pan and an ultrasonic generator fitted on the bottom of the water pan.

The second object of the present invention is to provide a method for dampening a plate of an offset press, comprising the steps of: forming a primary air stream along part of an outer surface of the plate by air ejected from a first jet of a nozzle, which jet is disposed in the vicinity of the surface of the plate and directed substantially at a tangent thereto and connected to a first chamber of the nozzle; and sucking out a water mist generated within a second chamber of the nozzle from a second jet thereof arranged directly underneath the first jet and directed substantially in the same direction as that of the first jet, which suction is effected by the air ejected from the first jet; whereby the water mist is sandwiched and held between the surface of the plate and an air film formed along the plate surface by the primary air stream.

According to the above structure, the water mist is pressed onto the plate surface by the air film which prevents a repulsion of the mist supplied onto the plate surface, whereby the water is effectively held on and adhered to the plate surface to form a thin film without being scattered out to the environment.

BRIEF DESCRIPTION OF THE DRAWINGS

The present invention will be described in more detail with reference to the drawings illustrating the preferred embodiments, wherein.

DESCRIPTION OF THE PREFERRED EMBODIMENTS

Figure 1:
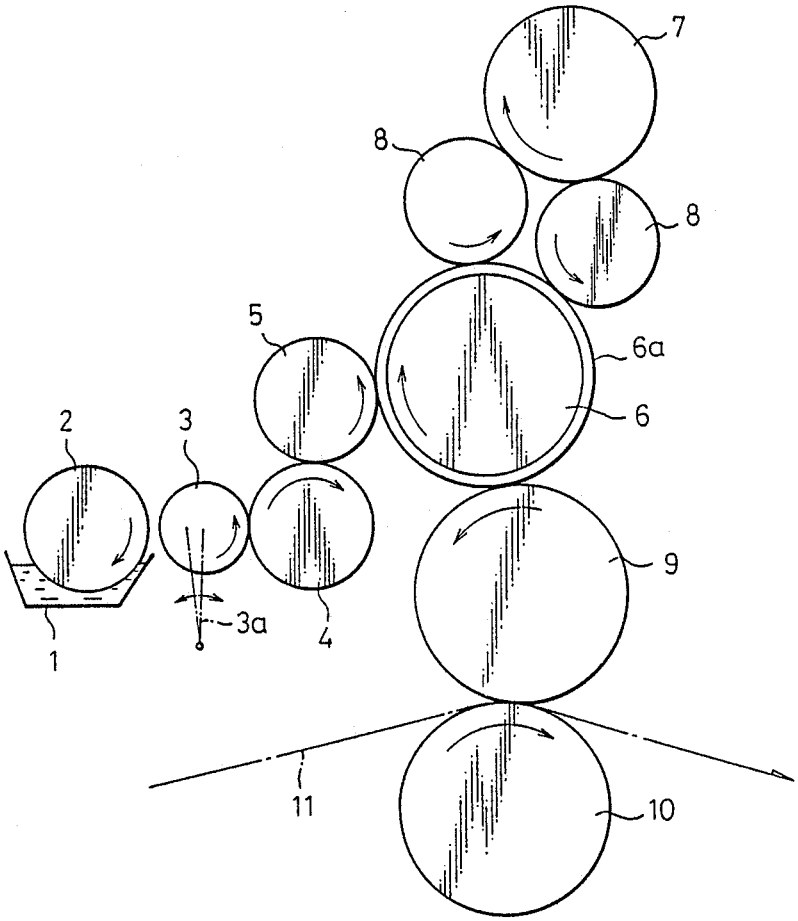
PRIOR ART Fig. 1
FIG. 1 is a diagrammatic side view of part of an offset press provided with a conventional dampening unit.
Figure 2:
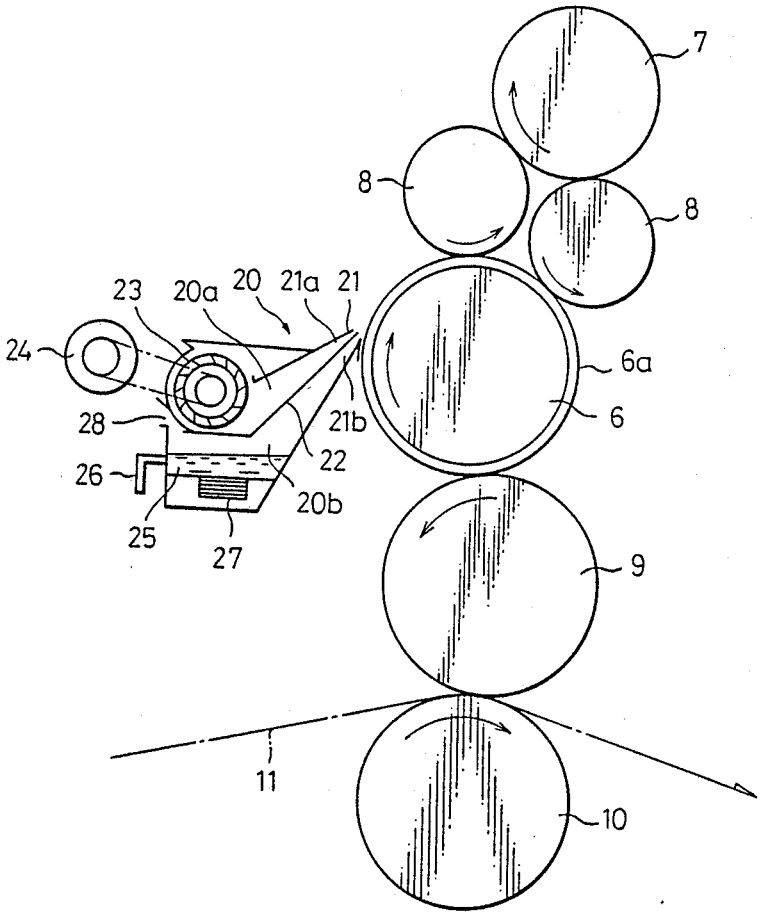
FIG. 2 is a diagrammatic side view of part of an offset press in which a dampening unit according to the present invention is assembled.

FIG. 2 illustrates a main part of an offset press provided with a dampening unit according to the present invention. In this drawing, the same reference numerals are used as in FIG. 1 except for those relating to the dampening unit. A description of parts common to FIG. 1 is omitted since they are substantially similar to the aforementioned conventional parts.

As illustrated, the dampening unit according to the present invention is not provided with rollers for transferring a water film onto a plate 6*a* carried by a plate cylinder 6. Instead, a nozzle 20 for ejecting air over a broad width area along the axis of the plate roller 6 is arranged in the vicinity of the surface of the plate 6*a* with a mouth 21 of the nozzle 20 being directed onto the surface of the plate 6*a* so that the air stream ejected from the mouth 21 follows the rotation of the plate cylinder 6, i.e., impinges on the surface thereof substantially at a tangent thereto. The mouth 21 preferably has an inner height of between 3 to 5 millimeters, and a gap between the mouth and the surface of the plate 6 of 1 to 3 millimeters.

The interior of the nozzle 20 is substantially separated into two parts, an upper chamber 20*a* and a lower chamber 20*b*, by a partition 22 extending in the lengthwise direction of the nozzle 20 parallel to the axis of the plate cylinder 6. The partition 22 also reaches the outer end of the mouth 21 so that first and second jets 21*a* and 21*b* are formed corresponding to the respective chambers 20*a*, 20*b*.

Inside the upper chamber 20*a* is arranged a blower fan 23 having a rotational axis extending in the axial direction of the plate cylinder 6. The fan 23 is driven by a motor 24 to generate an air stream directed to the first jet 21*a*. The lower chamber 20*b* is provided with a water bath 25 in the bottom wall thereof, in which a predetermined amount of water is filled through a conduit 26 connected to a water source (not shown). A plurality of ultrasonic generators 27 are arranged in series in the lengthwise direction of the nozzle 20 underneath the bottom wall of the water bath 25. A water mist is generated by the action of the ultrasonic generator 27 which vibrates the water in the bath 25 at a high frequency, and fills the lower chamber 20*b*. In FIG. 2, reference numeral 28 designates an air intake for the lower chamber 20*b*.

Next, the operation of the dampening unit having the above structure will be described.

Figure 3:
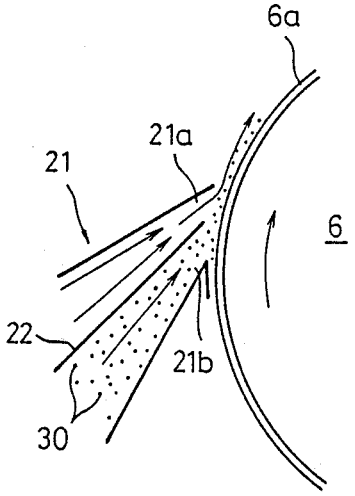
FIG. 3 is an enlarged side view of the dampening unit shown in FIG. 2.

In the normal operation of the offset press, the plating cylinder 6 rotates in the arrowed direction as shown in FIG. 1. The fan 23 is driven to generate an air stream in the upper chamber 20*a*, to be directed onto the surface of the plate 6*a* carried by the plate cylinder 6. The air stream is ejected from the first jet 21*a* to form a stable air film on the surface of the plate 6*a*. This air stream ejected from the first jet 21*a* causes the air pressure in the vicinity of the outer end of the second jet 21*b* disposed directly beneath the first jet 21*a* to be depressurized. The air within the second chamber 20*b* is sucked out of the interior of the lower chamber 20*b* through the second jet 21*b* to form a secondary air stream and ejected onto the plate 6*a* together with the primary air stream from the first jet 21*a*. At the same time, the water mist 30 (in FIG. 3) filling in the second chamber 20*b* is also made to flow out of the second chamber 20*b* through the second jet 21*b* and sandwiched between the air film formed by the primary air stream and the surface of the plate 6*a*. In this sandwiched condition, the water mist 30 is stably and effectively held on the plate surface without scattering to the environment.

On the contrary, if the primary air stream is eliminated and only an air stream mixed with the water mist is forcibly ejected onto the surface of the plate 61*a*, the mist is liable to be repulsed and scattered by the latter and a uniform formation of the water film thereon cannot be expected. Further, the mist is liable to adhere to the partition 22 and the inner wall of the nozzle 20, which causes a decrease in and fluctuations of the effective amount of mist to be delivered to the plate 6*a*.

According to the present invention, the mist supplied to the non-image area is pressed onto the plate surface by the air film formed by the primary air stream supplied from the first jet 21*a*, whereby the water film is held in place without being scattered and lost in the atmosphere. These conditions are diagrammatically illustrated in FIG. 3.

According to the present inventor, the particle size of the mist is also important for the adherence of the mist to the plate surface. The particle size in a range of from 15 μm to 18 μm is the most preferable. Therefore, the ultrasonic generator should be adjusted to form a water mist having such a particle size.

In the above embodiment, a fan is used to generate a first air stream, but of course, a known blower or an air jet connected to a pressurized air source can be used instead. Also, the water mist can be generated by a known spray or a rotary atomizer.

The thickness of the water film on the plate surface is adjustable by control of the fan rotation (adjustment of the blow rate) or control of the vibration of the ultrasonic generator (adjustment of mist generation). Moreover, in the above embodiment, in which a plurality of ultrasonic generators are arranged in series along the length of the water bath, if the respective generator is selectively operated by a known control means, the mist density in the lower chamber can be varied in the lengthwise direction of the water bath so that the supply of the water mist on the plate surface can be controlled in accordance with a ratio of the image carrying area to the non-image area in the widthwise direction of the plate.

Features of the present invention will be made more apparent by the following example:

EXAMPLE

Various printing tests were conducted on an offset press having the structure illustrated in FIG. 2, in which a plate FNS-A marketed by FUJI FILM K.K., Japan, four ultrasonic generators NB-83D marketed by TDK K.K., Japan, and a crossflow fan having a blow rate capacity of 1.6 $m^3$/min and a pressure of 1.5 mm Aq, are used.

The tests were carried out while varying a printing speed from 5 m/min to 200 m/min, and a supply rate of an ink SCR-TM087 BLACK HC marketed by TOYO INK K.K., Japan, to determine the upper limit of ink thickness printed on the paper without defects such as ink threading. Further the number of trial-and-error tests required before determination of the optimum dampening conditions of the plate when the printing conditions were varied, was estimated.

As a result, the upper limit of the ink thickness was represented by a D value of 1.62 measured by a Color Densiometer B318 marketed by X-RITE Co. Ltd, Grand Rapids Mi., U.S.A. Conversely, when using the conventional offset press shown in FIG. 1, the D value was 1.09, which means that more ink is carried on the plate compared to the conventional dampening unit according to the present invention. In this regard, the principle of this measurement is disclosed in U.S. Pat. No. 4,080,075.

Ten trial-and-error tests were sufficient to determine the optimum dampening conditions, which were much less than the 100 needed for the conventional dampening unit.

Moreover, the consumption of water for dampening the plate was less in the present invention relative to the conventional unit. This means that the thickness of the water film on the plate surface is minimized according to the present invention.

I claim:

1. A unit to be assembled with an offset press for dampening a plate carried by a rotating plate cylinder, comprising a nozzle with a discharging mouth in a slit form and directed substantially at a tangent to an outer surface of the plate and extending in an axial direction of the plate cylinder, the discharging mouth being disposed in the vicinity of the surface of the plate, the interior of the nozzle being divided into upper and lower chambers from the innermost area thereof to the discharging mouth by a partition extending in the direction of an air stream over the whole length of the nozzle, thereby partitioning said discharging mouth into first and second jets which are respectively in communication with said upper and lower chambers; means disposed within the upper chamber for generating an air stream through the first jet; and means disposed within the lower chamber for generating a mist for flow through said second jet said second jet being arranged in front of said first jet relative to the direction of rotation of said plate.

2. A unit for dampening a plate defined by claim 1, wherein said means for generating an air stream is selected from a fan, a blower, and a jet connected to a pressurized air source.

3. A unit for dampening a plate defined by claim 1, wherein said means for generating a mist comprises a water pan and an ultrasonic generator secured on the bottom of the water pan.

4. A method for dampening a plate of an offset press, comprising steps of: forming a primary air stream flowing along part of an outer surface of the plate by air ejected from a first jet of a nozzle, which jet is disposed in the vicinity of the surface of the plate directed substantially at a tangent thereto and connected to a first chamber of the nozzle; and sucking out a water mist generated within a second chamber of the nozzle from a second jet thereof arranged directly underneath and partitioned from the first jet and directed substantially in the same direction as that of the first jet, which suction is caused by air ejected from the first jet; whereby the water mist is sandwiched and held between the surface of the plate and an air film formed by the primary air stream.

5. A method for dampening a plate defined by claim 4, wherein a particle size of the water mist is in a range of 15 $\mu$m to 18 $\mu$m.

* * * * *